US009064658B2

(12) United States Patent
Ahlert

(10) Patent No.: US 9,064,658 B2
(45) Date of Patent: Jun. 23, 2015

(54) SWITCHING APPARATUS FOR AN ELECTRICAL SWITCHING DEVICE

(71) Applicant: Torsten Ahlert, Fürstenwalde (DE)

(72) Inventor: Torsten Ahlert, Fürstenwalde (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 155 days.

(21) Appl. No.: 13/705,266

(22) Filed: Dec. 5, 2012

(65) Prior Publication Data

US 2013/0180838 A1 Jul. 18, 2013

(30) Foreign Application Priority Data

Jan. 18, 2012 (DE) ..... 10 2012 200 662

(51) Int. Cl.

| | |
|---|---|
| ***H01H 5/00*** | (2006.01) |
| ***H01H 21/22*** | (2006.01) |
| ***H01H 77/02*** | (2006.01) |
| *H01H 1/20* | (2006.01) |

(52) U.S. Cl.

CPC ..... *H01H 21/22* (2013.01); *H01H 1/2058* (2013.01); *H01H 77/02* (2013.01); *H01H 2077/025* (2013.01)

(58) Field of Classification Search

CPC ..... H01H 9/00; H01H 71/00; H01H 71/10; H01H 73/00; H01H 75/00; H01H 77/00; H01H 79/00; H01H 2003/00

USPC ..... 200/400, 401, 19.22, 19.27, 43.01, 200/43.16, 43.19

See application file for complete search history.

(56) References Cited

U.S. PATENT DOCUMENTS

| | | | | |
|---|---|---|---|---|
| 8,553,385 | B2 * | 10/2013 | Ahlert | 361/102 |
| 2012/0026638 | A1 | 2/2012 | Ahlert | |

FOREIGN PATENT DOCUMENTS

| | | | |
|---|---|---|---|
| DE | 10013099 | A1 | 10/2001 |
| DE | 10036352 | A1 | 2/2002 |
| DE | 102007010943 | A1 | 12/2007 |
| DE | 102009015126 | A1 | 10/2010 |
| EP | 1315190 | A2 | 5/2003 |
| WO | WO 2007144049 | A1 | 12/2007 |
| WO | WO 2010112420 | A1 | 10/2010 |

* cited by examiner

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A switching apparatus for an electrical switching device is disclosed, in particular an electrical circuit breaker, for safeguarding at least two poles. A tripping element is included for each pole, supported moveably between a rest position and a tripping position. A common switching frame, movable between a pre-tension position and a switching position, is actively connected for force transmission to frame sections of the at least two tripping elements for the movement of the switching frame into the switching position upon movement of the tripping element into the tripping position. At least one spring element is embodied to apply force to the frame sections of the at least two tripping elements in the direction of the rest position of the at least two tripping elements.

16 Claims, 5 Drawing Sheets

SWITCHING APPARATUS FOR AN ELECTRICAL SWITCHING DEVICE

PRIORITY STATEMENT

The present application hereby claims priority under 35 U.S.C. §119 to German patent application number DE 10 2012 200 662.1 filed Jan. 18 2012, the entire contents of which are hereby incorporated herein by reference.

FIELD

At least one embodiment of the present invention generally relates to a switching apparatus for an electrical switching device, in particular an electrical circuit breaker, and/or a method for switching a switching apparatus.

BACKGROUND

Switching apparatuses for electrical switching devices, in particular electrical circuit breakers, are basically known. They are used for instance to safeguard line sections or current circuits. The circuit breakers can also be embodied as compact circuit breakers in the form of electrical switching devices.

To ensure that the switching apparatus is switched off in the event of short circuits or intensive current fluctuations, these are provided with tripping apparatuses. The tripping apparatuses are used to detect short circuits at one or more poles and accordingly to implement a switching of the switching apparatus (switch-off). A tripping element is provided herefor in known switching apparatuses, which is moveably supported between a rest position and a tripping position.

In the rest position, the tripping element is so-to-speak ready to implement a tripping process. If for instance a short-circuit current is perceived at a pole, the tripping element is moved into the tripping position so that, based on this movement, a switching mechanism is set into operation. In this embodiment of known switching apparatuses, an electric, magnetic or thermal transmission from the tripping element is used to transmit the tripping information for instance. It should be noted here that spring mechanisms are frequently used, which allow the tripping force to be adjusted for a tripping element.

In this process, when monitoring more than one pole, for instance with direct current having two poles or with alternating current having at least three poles, a plurality of such spring elements is needed. It should however be ensured that when monitoring at least two poles, the same or essentially the same tripping force is set for all poles. Aside from the increased complexity on account of a plurality of individual spring elements, these spring elements must be attuned to one another as well in respect of their fine tuning for the tripping forces.

A further disadvantage of known switching apparatuses is that the passing on of the tripping movement to a tripping mechanism, for instance a switch of the switching unit, also has to take place separately by each individual tripping element. The complexity and the costs of known switching apparatuses are therefore also significantly increased here.

SUMMARY

At least one embodiment of the present invention is directed to at least partly eliminating at least one of the aforecited disadvantages of known switching apparatuses for electrical switching devices. In particular, at least one embodiment provides a switching apparatus for an electrical switching device and also a method for switching a switching apparatus, which enable the safeguarding of at least two poles in a cost-effective and simple manner.

Further features and details of the invention result from the subclaims, the description and the drawings. Features and details, which are described therein in conjunction with embodiments of the inventive switching apparatus, naturally also apply in conjunction with embodiments of the inventive method and in each instance vice versa, so that with respect to the disclosure relating to the individual aspects of the invention, reference is or can always be made alternately.

An embodiment of an inventive switching apparatus for an electrical switching device, in particular an electrical circuit breaker, such as a compact circuit breaker, is used to safeguard at least two poles. Each pole is preferably assigned a phase of a circuit. If a direct current network is monitored by the switching apparatus, two poles are provided for these two phases, while with an alternating current network, at least three poles are monitored for instance for all three phases. Furthermore, a tripping element supported moveably between a rest position and a tripping position is provided for each pole. The tripping element can be moved for instance in a rotational or translational manner.

An embodiment of the present invention is also directed to a method for switching a switching apparatus in order to safeguard at least two poles, wherein at least one tripping element for a pole with a frame section is rotated from a rest position into a tripping position. In such a method, a switching frame common to at least two tripping elements is moved via the rotating frame section from a pre-tension position against the spring force of the spring element into a switching position and then by applying the spring force to the spring element, is moved again into the pre-tension position. An embodiment of an inventive method therefore describes the tripping situation of a switching apparatus, such as is embodied in particular in an inventive manner. Such a method therefore entails the same advantages as has been explained in detail with reference to an embodiment of an inventive switching apparatus. The spring force can also be referred to as tripping force and is preferably essentially identical for all tripping elements.

BRIEF DESCRIPTION OF THE DRAWINGS

The present invention is described in more detail with the aid of the appended figures. The terms used here "right" and "below" refer to an alignment of the figures with reference characters which can be read normally, in which, shown schematically.

Elements with the same function and mode of operation are provided in FIGS. 1 to 5 with the same reference characters in each instance.

DETAILED DESCRIPTION OF THE EXAMPLE EMBODIMENTS

Figure 1:
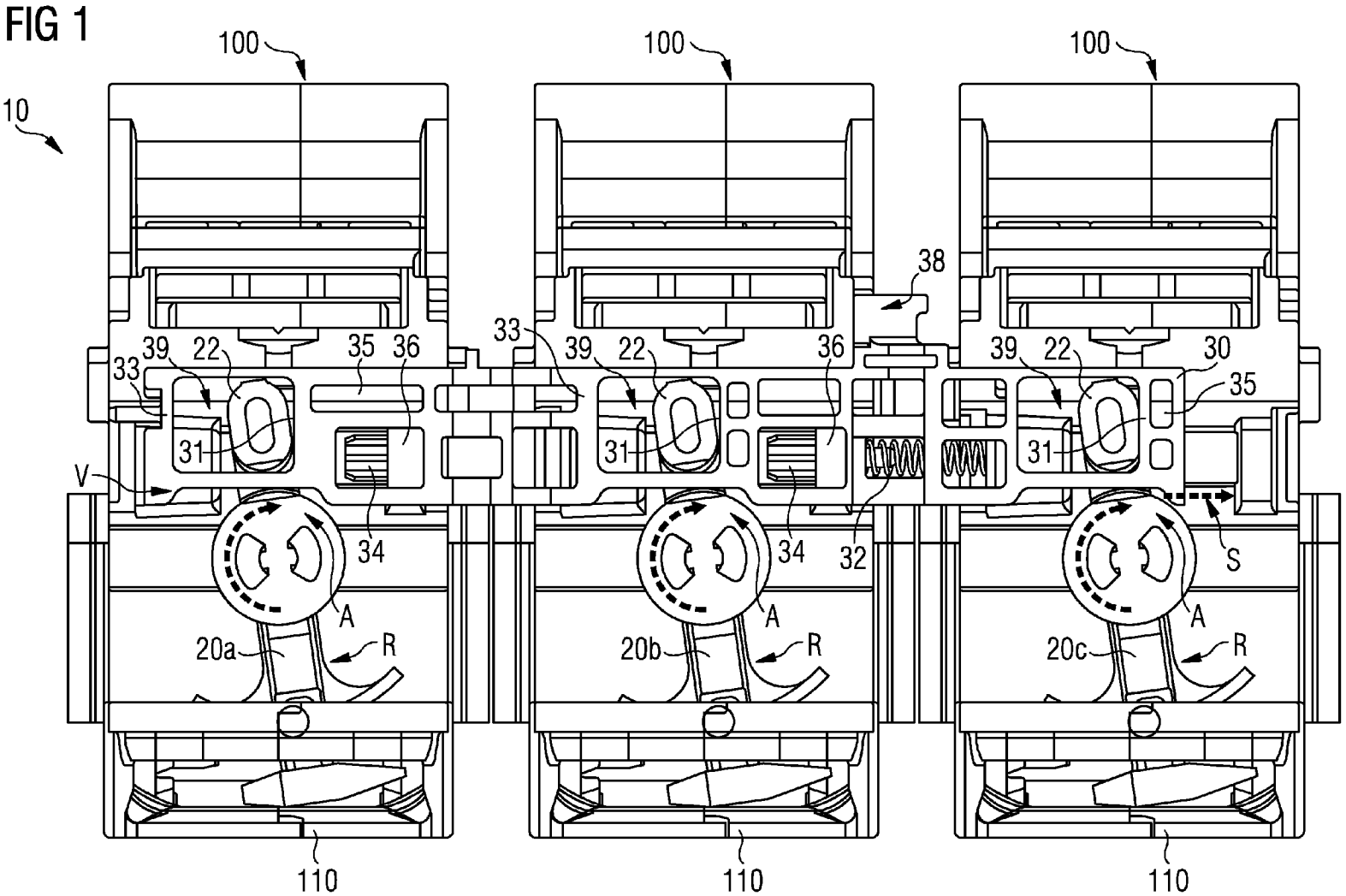
FIG. 1 shows a first embodiment of an inventive switching apparatus.
Figure 2:
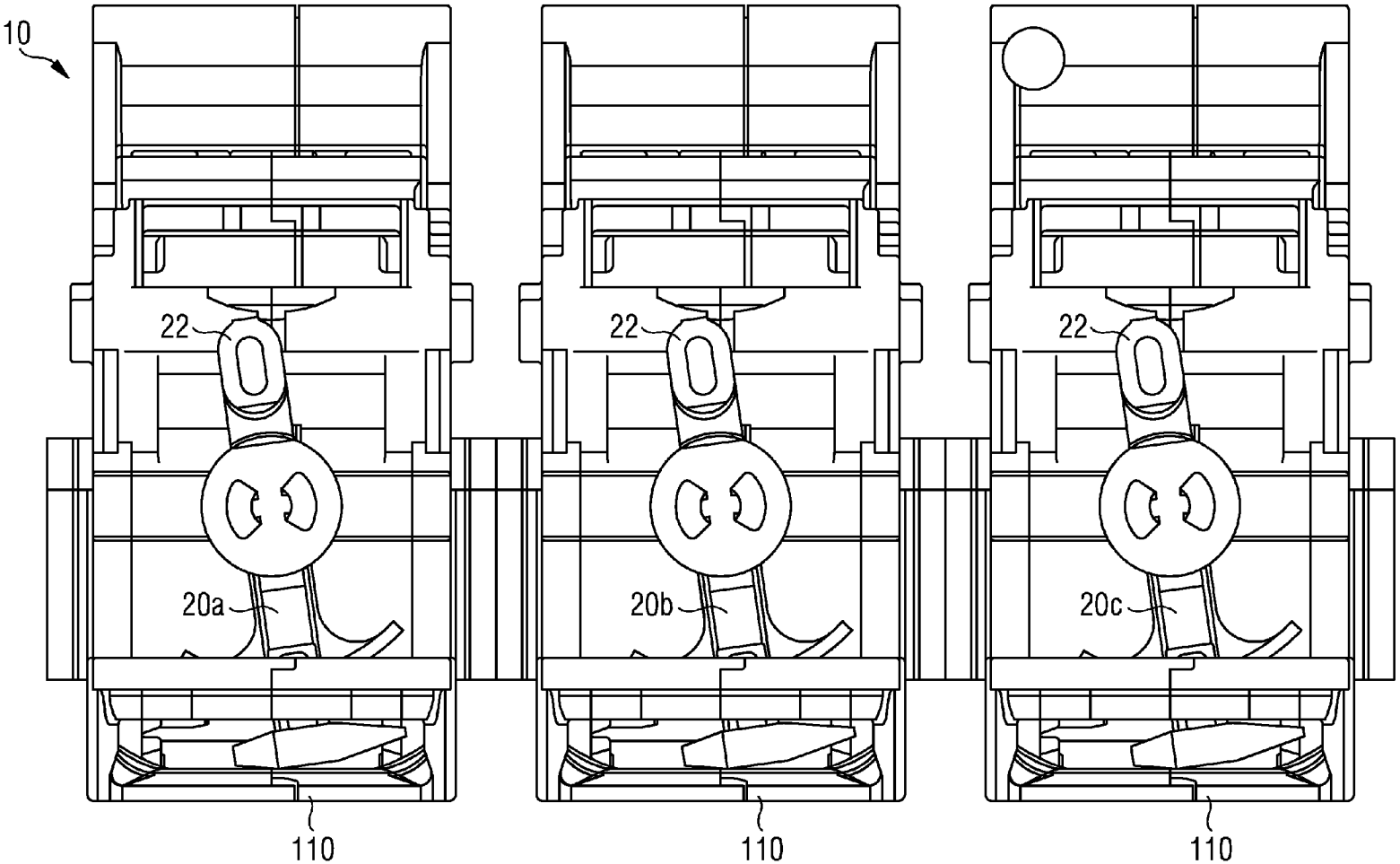
FIG. 2 shows the embodiment in FIG. 1 with a remote switching frame.
Figure 3:
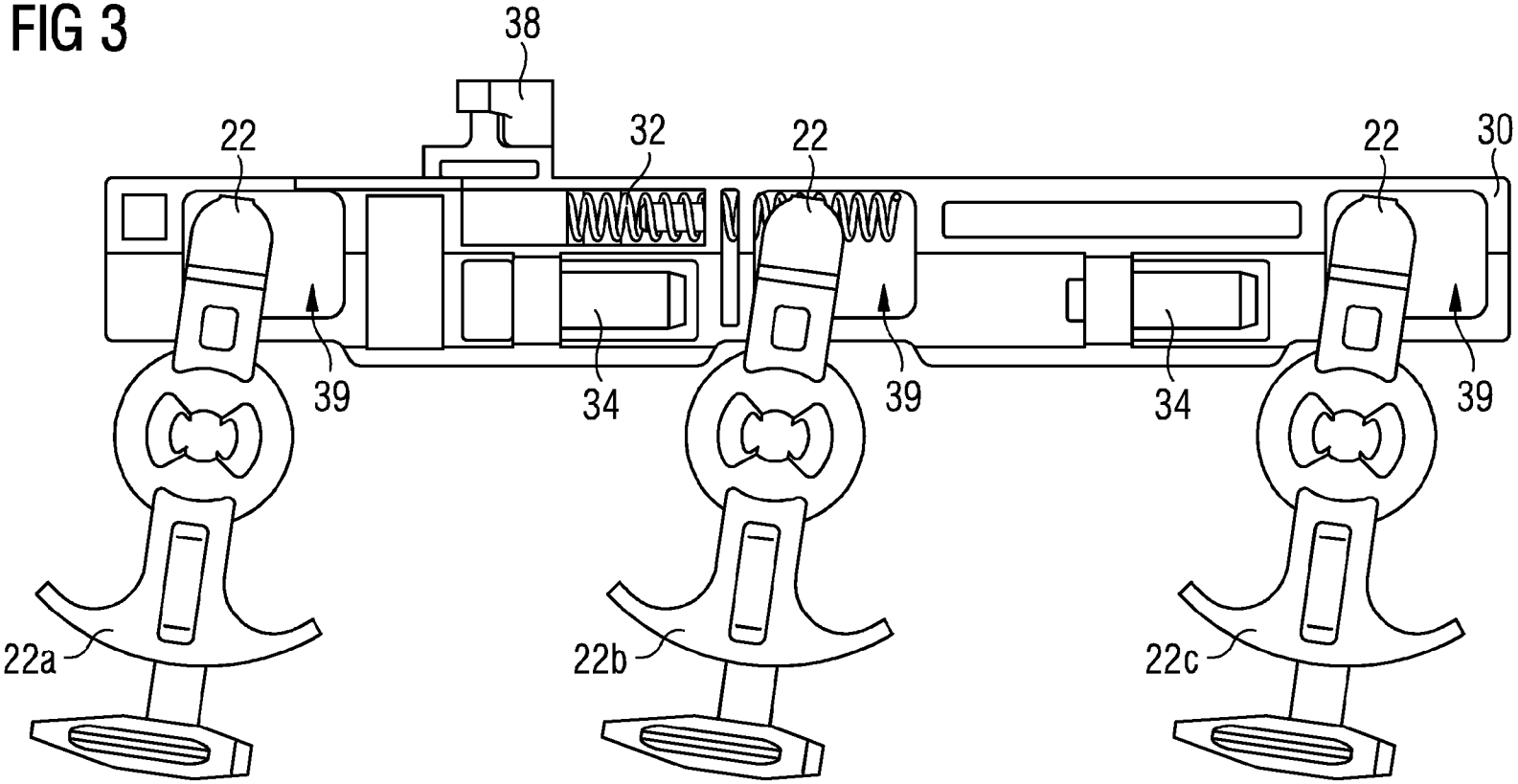
FIG. 3 shows a view from the rear of the switching frame with the tripping elements.
Figure 4:
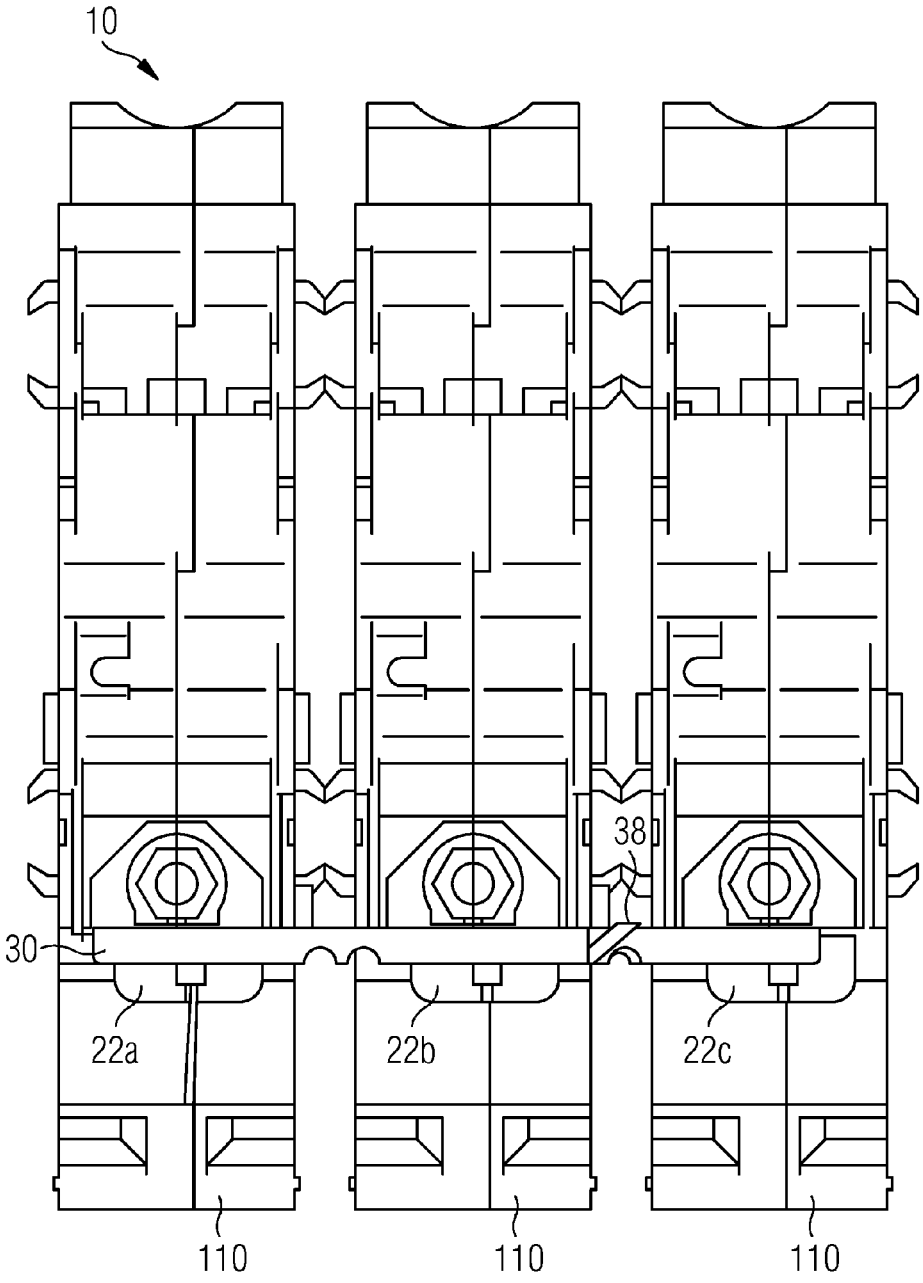
FIG. 4 shows a view from above onto the switching apparatus as shown in FIG. 1.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An embodiment of an inventive switching apparatus for an electrical switching device, in particular an electrical circuit breaker, such as a compact circuit breaker, is used to safeguard at least two poles. Each pole is preferably assigned a phase of a circuit. If a direct current network is monitored by the switching apparatus, two poles are provided for these two phases, while with an alternating current network, at least three poles are monitored for instance for all three phases. Furthermore, a tripping element supported moveably between a rest position and a tripping position is provided for each pole. The tripping element can be moved for instance in a rotational or translational manner.

An embodiment of an inventive switching apparatus is includes a common frame which can be moved between a pretension position and a switching position is provided for at least two tripping elements. The switching frame is actively connected to frame sections of the at least two tripping elements in manner so as to transmit force for the movement of the switching frame into the switching position upon movement of the tripping element in the tripping position.

Furthermore, the switching frame comprises at least one spring element which is embodied so as to apply force to the frame sections of the at least two tripping elements in the direction of the rest position of the at least two tripping elements. In other words, instead of a plurality of spring elements and a plurality of transmission components, a single spring element and a single, shared switching frame is used. This shared switching frame is used to provide the necessary tripping force for all tripping elements from one single spring element.

Accordingly, with embodiment of an inventive switching apparatus, only one single spring element must also be adjusted in respect of the force applied as tripping force to all tripping elements. If this preferably involves a compression spring for the spring element for instance, this can provide a defined tripping force in particularly low tolerance ranges for any number of tripping elements.

An embodiment of an inventive switching apparatus therefore functions basically such that the tripping movement of a single tripping element is sufficient to move the entire common switching frame against the force of the spring element into its switching position. It is therefore possible, irrespective of the number of tripping movements, in other words irrespective of the number of tripping elements to be tripped, to move the switching frame against the spring. The spring element can therefore also be understood as a common spring element for all tripping elements.

The spring element simultaneously serves to move the switching frame back into its pre-tension position. This reverse movement takes place by way of the spring force, which increases with the movement into the switching position. In other words, not only the switching frame, but also the respectively tripped tripping element is moved back indirectly via the switching frame. When there is tripping by a number of tripping elements, the switching frame correspondingly also resets all further tripped tripping elements into their rest position. This preferably takes place directly following a tripping process.

A plurality of poles can therefore be inventively safeguarded, so that a short circuit at one pole inventively results in a tripping process. Irrespective of at how many poles a tripping process has simultaneously taken place, the transmission of the tripping command or the definition of the tripping force is made available by a single common spring element or by a single common switching frame. Aside from reducing the components and reducing the corresponding costs, a common setting of the tripping force for all tripping elements is therefore possible in a particularly easy manner.

A detachable, contiguous contact is preferably understood by the term force-transmitting active contact. In other words, the frame section of the respective tripping element touches a corresponding surface section on the switching frame. In the event that only one single tripping element implements the movement of the switching frame in the switching position, in other words slides the switching frame into the switching position, the tripping element which has not be tripped can remain where it is. This contiguous contact therefore trips so that the force-transmitting active connection is also released. Appropriate freewheel is preferably provided herefor in the switching frame, as is explained again below.

The switching frame is essentially freely moveable, preferably however in a translational manner. For this purpose, it is correspondingly supported on a housing part or another component of the switching apparatus.

It may be preferable, with an embodiment of an inventive switching apparatus for the switching frame, in addition to defining the tripping force across the spring element, also to take over the transmission of the tripping command when it moves into the switching position. To this end, it may be equipped with further components or sections which can make available a transmission of the tripping information in a mechanical or other manner.

The switching frame is preferably embodied to be particularly light but nevertheless delivers the desired stability in a mechanical sense. This can be achieved for instance by means of an embodiment made of plastic, in particular by way of an injection molding method.

The tripping elements can also be referred to as a toggle or tripping toggle, and are provided in each instance for a pole which is also to be referred to as a switching unit. The individual frame sections so-to-speak have force applied to them via the switching frame by the common spring element. The switching frame can therefore also be understood to mean a distributor for applying force to the tripping elements by means of the spring element.

An embodiment of an inventive switching apparatus is preferably embodied with evaluation electronics for the tripping elements. A switch of the switching apparatus can thus be moved out of an ON position in a particularly simple manner in the event of one pole tripping even with evaluation electronics at zero current. In particular, the switch is moved directly or indirectly out of the ON position into an OFF position by way of the common switching frame. The problem is in particular solved in this way in that when using an evaluation electronics, this is initially too slow and then at zero current.

A further advantage is, if in an embodiment of an inventive switching apparatus, the switching frame can be moved between the pre-tension position and the switching position in a translational manner and/or the tripping elements can be rotationally moved between the rest position and the tripping position. These two variants, in particular the combination of the two types of movement, result in a particularly simple and compact design. Since the individual poles are usually arranged adjacent to one another in a switching apparatus, the rotational movement of the tripping element is used in each instance to prevent the tripping element from projecting beyond the lateral extension of such a pole. Sufficient installation space is available within the pole in order to implement the corresponding rotational movement. The switching frame extends beyond all poles, so that it will frequently comprise an essentially longitudinal extension. Using a translational movement for this longitudinal extension further reduces the necessary installation space for the switching frame and the constructional effort to manufacture the frame.

It is likewise advantageous if, with an embodiment of an inventive switching apparatus, the switching frame is supported by way of pins, which can be moved in a translational manner in guide openings, in order to move between the pretension position and the switching position. The mounting process preferably takes place in further components of the switching apparatus, for instance housing components or the individual housings of the pole or the switching units. In this process, a kinematic reversal is easily possible irrespective of the type of mounting. The pins can therefore be fastened to the switching frame, said pins being supported in guide openings in the individual pole units. It is however naturally also possible to provide pins on the respective housing of the pole unit, which in turn engage in guide openings in the switching frame with a translational moveability. Both the pins, and also the guide openings with the respective corresponding component are preferably embodied in an integral, in particular monolithic manner.

A translational moveability is understood to mean a movement essentially along an axis. Stops may be provided, which define the end positions of the switching frame. These stops can be embodied separately from the pins and the guide openings, and are in particular provided by an outer housing. Assembly is thus a simple matter, since a geometric block is automatically predetermined by the outer housing, so that the pins can be easily inserted into the guide openings without further additional securing mechanisms or suchlike.

A pin is not necessarily understood to be an element with a round cross-section. Other cross-sections, such as for instance ellipsoidal, square, rectangular, triangular or other cross-sectional forms are also conceivable within an embodiment of the scope of the present invention. An embodiment of an inventive pin can therefore also be referred to as a projection. The pins can even be guided in the guide openings in the manner of a guide rail. With complex translational movements, this would represent a particularly advantageous embodiment.

A further advantage can be achieved if, in an embodiment of an inventive switching apparatus, the switching frame comprises a switching section which is embodied to actuate a switch for switching the switching apparatus upon the movement of the switching frame from the pre-tension position into the switching position. The switching section is therefore used to fulfill a second functionality of the switching frame, namely to transmit the tripping command or the tripping information from the respective tripping element. The switch itself can in turn be embodied in any manner. It can be a magnetic switch, an electronic switch, a thermal switch or a switch functioning in another way. In particular, the switch has a tripping catch, which comes into contact with the switching section of the switching frame during its movement into the switching position and is moved. In other words, the switching section is used, on account of its geometric displacement along with the switching frame, to displace such a tripping catch into an active position.

It may be advantageous if, with an embodiment of an inventive switching apparatus, the switching section is embodied at least in sections as a bevel, which, relative to the movement direction of the switching frame, makes an angle of less than 90°, in particular between approx. 30° and approx. 60°. This bevel enables a particularly simple transmission of the tripping command. If the switching section moves in the direction of the switching position, this bevel will result in a corresponding tripping catch being moved into another position. The displacement direction of the tripping catch is preferably embodied at right angles here or essentially at right angles to the translational direction of the switching frame. The bevel with an engagement in a range between approx 30° and approx 60° results in a particularly low frictional force and nevertheless a corresponding displacement path being made available for the movement of the tripping catch of a switch.

Within the scope of the present invention, it may be advantageous, if in an embodiment of an inventive switching apparatus, the spring element is embodied as a compression spring, in particular in the form of a spiral spring. A compression spring, in particular in the form of a spiral spring, is particularly advantageous in the required tight tolerance ranges, since such a compression spring enables the spring force to be set with low tolerances. Nevertheless, other spring element types, such as for instance extension springs, coil springs or suchlike, are also conceivable within the scope of the present invention. A coil spring does not necessarily have to be used. It is therefore possible for plastic components, like for instance elastomer components, to be used for the spring element.

It is further advantageous if, in an embodiment of an inventive switching apparatus, the switching frame comprises a surface with a reduced sliding friction, at least in sections, in particular at contact surfaces with the frame sections. This means that a reduced friction for the drive by the frame section of the respective tripping element is made available for the movement of the switching frame itself. Since an additional force is required to overcome the frictional forces, the possible force which can be produced with the tripping process, in other words with the tripping movement of the tripping elements, by way of the switching frame, for instance to a switching section, therefore reduces. This results in the necessary spring force being reduced with a reduced friction according to the present invention in this embodiment, so that a smaller and more cost-effective spring element can be used. By reducing the sliding friction, the speed of the movement of the switching frame is further increased, so that the switching process can be implemented particularly quickly in the desired manner. A reduced sliding friction can be achieved for instance by a surface treatment, in particular by a reduced roughness. Alternatively, coatings are conceivable, which comprise a Teflon portion for instance. The entire material of these surface sections or volume sections on the contact surfaces with the frame sections can be embodied from a material with a corresponding sliding portion, like for instance Teflon.

A further advantage can be achieved if, in an embodiment of an inventive switching apparatus, the switching frame for each frame section comprises an associated freewheel area, which is embodied such that when the tripping element is moved into the tripping position, the untripped tripping elements remain in the rest position upon movement of the switching frame. In other words, the tripping elements which do not trip are not included in the tripping instance, or not dragged along by the switching frame. This means that only the individual tripping element to be tripped implements the movement of the switching frame and no additional movement of the other tripping elements has to be assisted.

This free travel or freewheel prevents a force displacing or dragging along the remaining tripping elements, so that an increased speed or an increased switching force can as a result be provided by the switching frame. In other words, with a tripping element remaining in the rest position, the freewheel area is embodied to prevent a collision between the switching frame and the frame section of the upright tripping element upon movement of the switching frame into the switching position. This step of freewheeling can also be referred to as decoupling, since the contact, in other words the force-transmitting active contact, preferably releases between such a frame section and the switching frame. The freewheel play areas are preferably embodied in the form of a window.

It may be advantageous if with an embodiment of an inventive switching apparatus if the force-transmitting active contact between the switching frame and the frame sections is a detachable, contiguous contact in each instance. This means that when tripping a single tripping element, this contiguous contact can be released and cancelled for the other tripping elements, so that a dragging along of the untripped tripping elements is prevented in particular in correlation with the afore-cited freewheel areas.

It is similarly advantageous if, in an embodiment of an inventive switching apparatus, the switching frame comprises openings and/or reinforcements. This results in a reduction in the weight and but still adequate rigidity of the switching frame. The reduction in the weight on the one hand decreases the material outlay and thus the costs and on the other hand increases the speed of the switching process. The switching frame is preferably embodied in the form of a framed structure or truss.

An embodiment of an inventive switching apparatus can be further developed such that the frame section comprises an outer contour at least in sections, which is embodied such that upon rotation of at least one tripping element into the tripping position, the switching frame is moved into the switching position and in the process the frame section rolls over this outer contour onto the contact surface of the switching frame. In particular, the rolling reduces the wear and the friction that arises, since a sliding friction translates into a rolling friction. Aside from the reduced power loss on account of the reduced friction, the speed of the switching process is thus increased. The wear is also reduced so that an inventive switching apparatus can remain in use longer, and in particular without the need for maintenance.

An embodiment of the present invention is also directed to a method for switching a switching apparatus in order to safeguard at least two poles, wherein at least one tripping element for a pole with a frame section is rotated from a rest position into a tripping position. In such a method, a switching frame common to at least two tripping elements is moved via the rotating frame section from a pre-tension position against the spring force of the spring element into a switching position and then by applying the spring force to the spring element, is moved again into the pre-tension position. An embodiment of an inventive method therefore describes the tripping situation of a switching apparatus, such as is embodied in particular in an inventive manner. Such a method therefore entails the same advantages as has been explained in detail with reference to an embodiment of an inventive switching apparatus. The spring force can also be referred to as tripping force and is preferably essentially identical for all tripping elements.

An embodiment of an inventive method can be further developed such that, upon movement into the switching position, the switching frame actuates a switch to switch the switching apparatus via a switching section. This results in a dual functionality likewise being made available in an inventive manner. Aside from resetting the individual tripping elements, a transmission of the tripping command can take place, which is transmitted for instance with a tripping catch of a switch.

An embodiment of an inventive method may develop such that the switching apparatus is embodied according to an embodiment of the present invention.

FIG. 1 shows that in this embodiment, the switching apparatus 10 is embodied for three poles 100. A switching unit 110 is provided for each pole 100. Each pole 100 is equipped with a tripping element 20*a*, 20*b* and 20*c*. All three tripping elements 20*a*, 20*b* and 20*c* can be rotated between a tripping position A and a rest position R. FIG. 1 shows the rest position R for all tripping elements 20*a*, 20*b* and 20*c*. Furthermore, each tripping element 20*a*, 20*b* and 20*c* comprises a frame section 22. This is actively connected, in a detachable manner, to a switching frame 30. To this end, three windows are provided in the switching frame 30, which are significantly larger in respect of their geometric extension than applies to the respective frame section 22. The enlarged windows can in part also be referred to as freewheel area 39.

The method of operation during tripping will be briefly described below. The switching frame 30 has a spring element 32, which rests against a housing of the switching apparatus 10 or one of the switching units 110 of a pole 100. Force is therefore applied in the direction of the rest position R of the individual tripping elements 20*a*, 20*b* and 20*c*. If the right-hand tripping element 20*c* trips for instance, it is rotated out of the rest position R, as shown in FIG. 1, in the clock-wise direction into the tripping position A. The switching frame 30 in FIG. 1 is moved to the right by way of the frame section 22 via a contact surface 31 of the switching frame 30. On account of the freewheel areas 39 in the remaining windows of the two other poles 100 of the switching frame 30, the two further tripping elements 20*a* and 20*b* are prevented from moving. Instead, these move in the freewheel area 39 without colliding with the switching frame 30. Upon the movement of the switching frame 30 to the right into its switching position S, force is stored in the spring element 32 or introduced into the spring element 32.

During this translational movement, the switching frame 30 is guided by way of pins 34, which are essentially embodied integrally with the switching frame 30. They are supported in a translationally moveable manner in the guide openings 36, which are in turn arranged on the respective switching unit 110.

The switching frame 30 is furthermore provided with openings 35 and reinforcement ribs 33, in order to provide the desired rigidity with the lowest possible material outlay.

Figure 5:
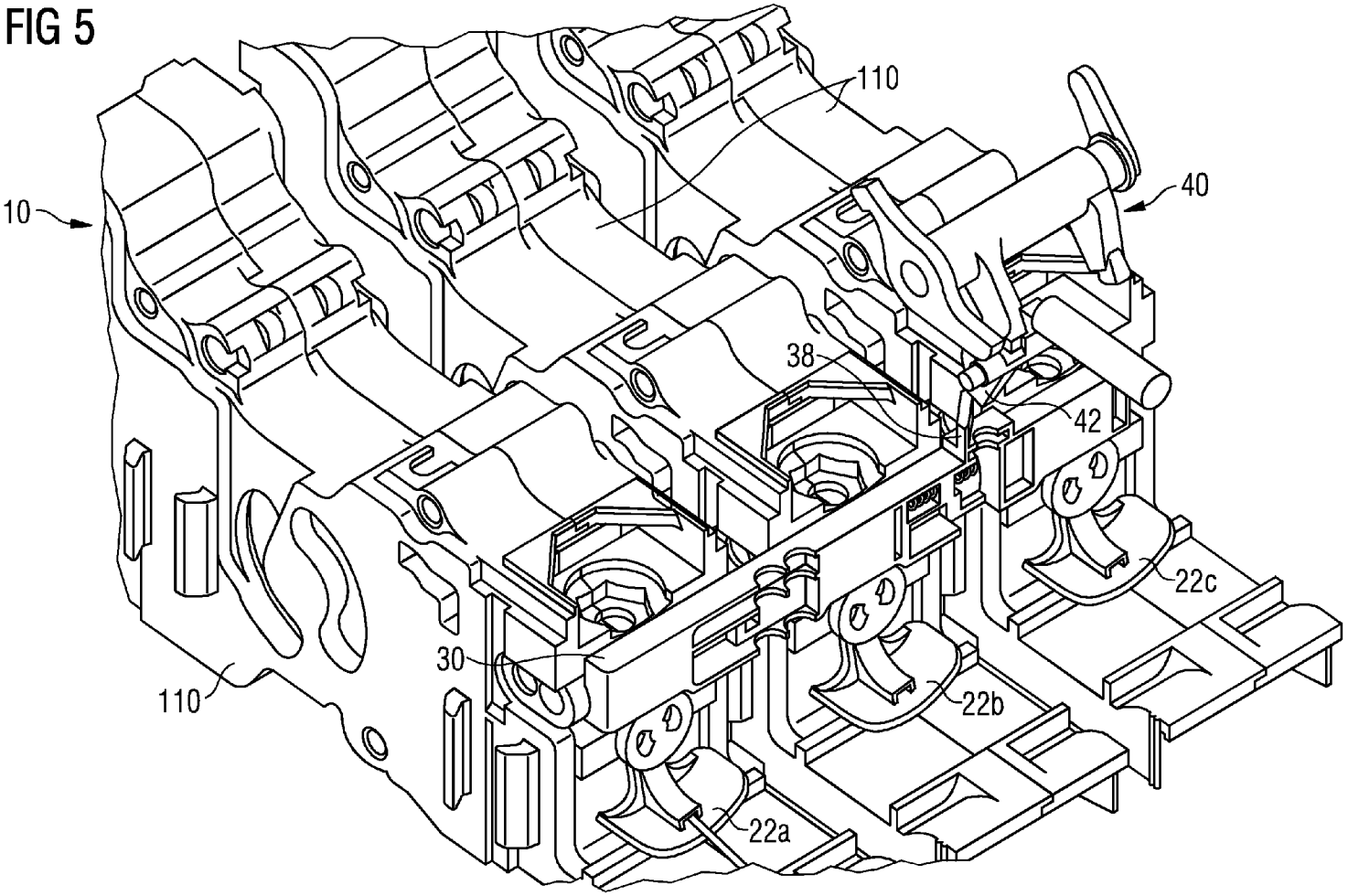
FIG. 5 shows a perspective view of a switching apparatus with an indicated switch.

FIGS. 1, 3, 4 and 5 furthermore show that the switching frame 30 also has a switching section 38. This is embodied as a beveled plane or beveled surface, which is embodied at an angle of approx. 45° relative to the direction of the translational movement of the switching frame 30. Furthermore, as shown in FIG. 5, a switch 40 is provided, which is or can be brought into mechanical contact with the switching section 38 by way of a tripping catch. FIG. 5 shows that if the switching frame 30 is moved to the right, the beveled surface of the switching section 37 moves the catch of the switch 30 downwards to the right. This compensates for a tripping movement, which, in a magnetic or thermal or other selective manner, implements a switching process for all or also only one pole. If a tripping signal is received, and the respective tripping element rotates following the same, a common tripping via the common switching frame 30 can take place irrespective of whether one, two or all poles experience such a tripping situation.

The afore-cited explanation of the embodiments describes the present invention only within the scope of examples. Naturally individual features, if technically meaningful, can be freely combined with one another, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Switching apparatus
20*a* Tripping element
20*b* Tripping element
20*c* Tripping element
22 Frame section
30 Switching frame
31 Contact surface with the frame section
32 Spring element
33 Reinforcement rib
34 Pin
35 Opening
36 Guide opening
38 Switching section
39 Freewheel area
40 Switch
42 Switching lever
100 Pole
110 Switching unit for a pole
R Rest position
A Tripping position
V Pre-tension position
S Switching position

What is claimed is:

1. A switching apparatus for an electrical switching device, for safeguarding at least two poles, comprising:

at least two tripping elements, supported moveably between a rest position and a tripping position, each of the at least two tripping elements being for a respective one of the at least two poles;

at least one spring element, embodied to apply force to frame sections of the at least two tripping elements in a direction of the rest position of the at least two tripping elements; and a common switching frame for the at least two tripping elements, the common switching frame being movable between a pre-tension position and a switching position and being configured to engage with frame sections of the at least two tripping elements such that the common switching frame moves against the force of the at least one spring element from the pre-tension position into the switching position upon movement of at least one of the tripping elements into the tripping position, wherein the common switching frame comprises a switching section protruding from a surface of the common switching frame, the switching section being embodied to actuate a switch for switching the switching apparatus when the common switching frame is moved from the pre-tension position into the switching position, wherein, for each frame section, the common switching frame includes an associated freewheel area, embodied such that when one of the at least two tripping elements is moved into the tripping position, any untripped tripping elements of the at least two tripping elements remain in the rest position upon movement of the common switching frame.

2. The switching apparatus of claim 1, wherein at least one of:

the common switching frame is movable in a translational manner between the pre-tension position and the switching position; and the tripping elements are movable in a rotational manner between the rest position and the tripping position.

3. The switching apparatus of claim 2, wherein the common switching frame is supportable by way of pins, movable in a translational manner in guide openings, for movement between the pre-tension position and the switching position.

4. The switching apparatus of claim 1, wherein the switching section is embodied as a bevel at least in sections, which, for the movement direction of the common switching frame, makes an angle of less than 90 degrees.

5. The switching apparatus of claim 1, wherein the at least one spring element is embodied as a compression spring.

6. The switching apparatus of claim 1, wherein the common switching frame comprises a surface with reduced sliding friction, at least in sections.

7. The switching apparatus of claim 1, wherein a force-transmitting active contact between the common switching frame and the frame sections is a detachable, contiguous contact in each instance.

8. The switching apparatus of claim 1, wherein the common switching frame comprises at least one of openings and reinforcement ribs.

9. The switching apparatus of claim 1, wherein each frame section comprises an outer contour at least in sections, embodied such that, upon rotation of at least one tripping element into the tripping position, the frame section rolls on a contact surface of the common switching frame to move the common switching frame into the switching position.

10. A method for switching a switching apparatus for safeguarding at least two poles, comprising:

rotating a frame section of at least one tripping element from a rest position into a tripping position, the at least one tripping belonging to a respective one of the at least two poles;

moving a common switching frame for the at least one tripping element and at least one other tripping element, via the rotated frame section, from a pre-tension position against a spring force of a spring element into a switching position; and moving the common switching frame back into the pre-tension position again by applying the spring force to the spring element, wherein the moving a common switching frame from the pre-tension position into the switching position actuates a switch for switching the switching apparatus by way of a switching section that protrudes from a surface of the common switching frame, wherein the frame section is one of a plurality of frame sections associated with the common switching frame, and for each frame section, the common switching frame includes an associated freewheel area, embodied such that when one of the at least one tripping element and the at least one other tripping element is moved into the tripping position, an untripped one of the at least one tripping element and at least one other tripping element remains in the rest position upon movement of the common switching frame.

11. The method of claim 10, wherein the method is implemented for a switching apparatus.

12. The switching apparatus of claim 1, wherein the switching apparatus is for an electrical circuit breaker.

13. The switching apparatus of claim 1, wherein the switching section is embodied as a bevel at least in sections, which, for the movement direction of the common switching frame, makes an angle between around 30° and around 60°.

14. The switching apparatus of claim 5, wherein the at least one spring element is embodied in the form of a coil spring.

15. A method for switching the switching apparatus of claim 1 for safeguarding at least two poles, the method comprising:

rotating the frame section of at least one of the at least two tripping elements from the rest position into the tripping position; and moving the common switching frame via the rotated frame section, from the pre-tension position into the switching position against the force of the at least one spring element; and moving the common switching frame from the switching position into the pre-tension position again by applying the force to the at least one spring element.

16. The method of claim 15, wherein the moving the common switching frame from the pre-tension position into the switching position actuates a switch for switching the switching apparatus by way of a switching section.

* * * * *